United States Patent [19]

Daeschler et al.

[11] Patent Number: 4,899,822

[45] Date of Patent: Feb. 13, 1990

[54] APPARATUS FOR CONTROLLING THE OPERATION OF AN UNDERWATER INSTALLATION

[75] Inventors: Jean-Louis Daeschler, Tarland; Anthony J. Asbury, Norwich, both of Great Britain

[73] Assignee: Camco Inc., Houston, Tex.

[21] Appl. No.: 240,058

[22] Filed: Sep. 2, 1988

[30] Foreign Application Priority Data

Sep. 4, 1987 [GB] United Kingdom ..... 8720777

[51] Int. Cl.[4] ..... E21B 43/01

[52] U.S. Cl. ..... 166/339; 166/65.1; 166/341; 166/344; 166/365; 405/169; 439/137; 439/191; 439/669

[58] Field of Search ..... 166/335, 338, 339, 341, 166/344, 360, 65.1, 366, 365; 439/668, 669, 190–195, 137, 140; 405/169; 137/236.1, 798, 884, 594

[56] References Cited

U.S. PATENT DOCUMENTS

| | | | |
|---|---|---|---|
| 3,339,632 | 9/1967 | Lewis | 166/335 |
| 3,486,556 | 12/1969 | Burgess | 166/338 |
| 3,633,667 | 1/1972 | Falkner, Jr. | 166/366 |
| 3,839,608 | 10/1974 | De Vries | 439/137 X |
| 4,080,025 | 3/1978 | Garnier et al. | 439/137 X |
| 4,117,287 | 9/1978 | Walker et al. | 439/191 X |
| 4,411,454 | 10/1983 | Nayler et al. | 439/195 X |
| 4,444,218 | 4/1984 | Bangh | 166/341 X |
| 4,494,602 | 1/1985 | Capdeboscq et al. | 439/192 X |
| 4,525,918 | 7/1985 | Puritz | 439/191 X |
| 4,661,017 | 4/1987 | Wood et al. | 405/169 |
| 4,682,913 | 7/1987 | Shatto et al. | 166/344 X |
| 4,770,248 | 9/1988 | Houlgrave et al. | 166/65.1 X |

FOREIGN PATENT DOCUMENTS

| | | | |
|---|---|---|---|
| 86/00353 | 1/1986 | PCT Int'l Appl. | 166/365 |
| 86/01852 | 3/1986 | PCT Int'l Appl. | 166/341 |
| 88/03596 | 5/1988 | World Int. Prop. O. | 166/341 |
| 1472229 | 5/1977 | United Kingdom . | |
| 1555719 | 11/1979 | United Kingdom | 439/192 |
| 1576897 | 10/1980 | United Kingdom . | |
| 2059483 | 4/1981 | United Kingdom . | |
| 2137677 | 10/1984 | United Kingdom . | |
| 2152556 | 8/1985 | United Kingdom . | |
| 2152565 | 8/1985 | United Kingdom . | |
| 2167469 | 5/1986 | United Kingdom . | |
| 2174442 | 11/1986 | United Kingdom . | |
| 2194980 | 3/1988 | United Kingdom | 166/338 |

*Primary Examiner*—Hoang C. Dang

*Attorney, Agent, or Firm*—Ostrolenk, Faber, Gerb & Soffen

[57] ABSTRACT

Control apparatus for a sub-sea wellhead installation, for example of a satellite well, is disclosed which includes a plurality of control devices 80 each for providing a control function for the installation 10 and a connector 40, 45, 50 for connecting the devices 80 to the installation 10, each control device being independently engageable and disengageable with the connector 40, 45, 50. The connector includes a manifold 40 to which are connected a plurality of receptacles 50, each control device 80 being engageable with the the receptacle 50. The receptacles and control devices are preferably provided with complementary engageable portions 52, 54, 56; 82, 84, 86, which include hydraulic and electrical connectors 58, 60, 62, 70, 72; 88, 90, 92, 98, 100, so that control signals may be passed via the connectors 40, 45, 50 to the control devices 80 from a command installation and actuation signals may be passed from the control devices 80 through the connector 40, 45, 50 to devices on the installation 10.

15 Claims, 5 Drawing Sheets

APPARATUS FOR CONTROLLING THE OPERATION OF AN UNDERWATER INSTALLATION

This invention relates to apparatus for controlling the operation of an underwater installation.

DESCRIPTION OF THE PRIOR ART

Satellite and marginal subsea well head installations control the flow of oil from the well and also provide safety systems, such as blow out prevention (B.O.P.) units. The control system for such an installation generally includes a number of valves, which are actuated by pilot valves which are controlled, via hydraulic or electrical control lines or by acoustic signals, or combination of these, from a drilling rig or other surface installation.

For such control systems, the mean time between failure (M.T.B.F.) rates for mechanical and interface components is relatively low and in addition maintenance and operating costs are high due to the complex equipment needed for the retrieval of the control elements from sea bed locations for repair or service, and the time space of extensive logistic support.

In order to improve performance and maintain reliability, systems have been proposed in which the control components are designed into a retrievable, sealed oil filled pod control unit. High standards are necessary for the system cleanliness and component design in order to ensure a reasonable level of reliability and M.T.B.F., thus making the units extremely costly. Typically, such a unit is positioned on the subsea installation using special tooling from floating work barges or service vessels using soft landing guide wires and latching pins located on the subsea well installation. The weight of the control unit is typically 1.5 tonnes or more and requires substantial framing and counterweights on the installation to balance the loads on the well head tree.

It is a disadvantage of such a control system that a total retrieval of the control unit is necessary in order to perform maintenance or repairs on a particular item or circuit.

It is an object of the invention to provide control apparatus which alleviates the disadvantages of the prior art.

SUMMARY OF THE INVENTION

According to the invention in a first aspect, there is provided a connector for connection to an installation and for engagement with a control device for controlling a function of the installation, the device including a control element, the connector being slidably engagable with a complementary engagement member of the device and including means for transferring hydraulic and electrical signals between the installation and the control device when engaged therewith.

According to the invention in a second aspect, there is provided a connector for connection to an installation and for engagement with a control device for controlling a function of the installation, the device including a control element, the connector being slidably engageable with a complementary engagement member of the device and including means for transferring hydraulic and electrical signals between the installation and the control device when engaged therewith.

According to the invention in a third aspect, there is provided underwater installation control apparatus comprising a plurality of control devices each for providing a control function for the installation and connection means for connecting the devices to the installation, each control device being independently engageable with and disengageable from the connection means and wherein said connection means includes a plurality of connectors coupled to a connection panel at respective predetermined locations, each connector being arranged to engage a respective control device. Preferably, the connection means includes a plurality of individual receptacles, each control device being engagable with a said receptacle. The receptacles and control devices are preferably provided with complementary engagable portions which include hydraulic and electrical connection means, so that control signals may be passed via the connection means to the control devices from a command installation (for example a drilling rig) and actuation signals may be passed from the control devices through the connection means to devices on the installation.

Preferably, the control devices each include a pilot valve for operation of a respective main valve of a well head installation.

More preferably, the control devices are arranged to be removable by a remote vehicle which engages the connection member.

BRIEF DESCRIPTION OF THE DRAWINGS

Embodiments of the invention will now be described by way of example, with reference to accompanying drawings in which.

DESCRIPTION OF THE PREFERRED EMBODIMENTS

With reference to the figures, an embodiment of the invention is shown. Unlike the prior art control system in which all the control devices are retained in a single oil filled pod, the embodiment of the invention shown includes a control panel or manifold in which individual control devices may be independently engaged and disengaged.

Figure 1:
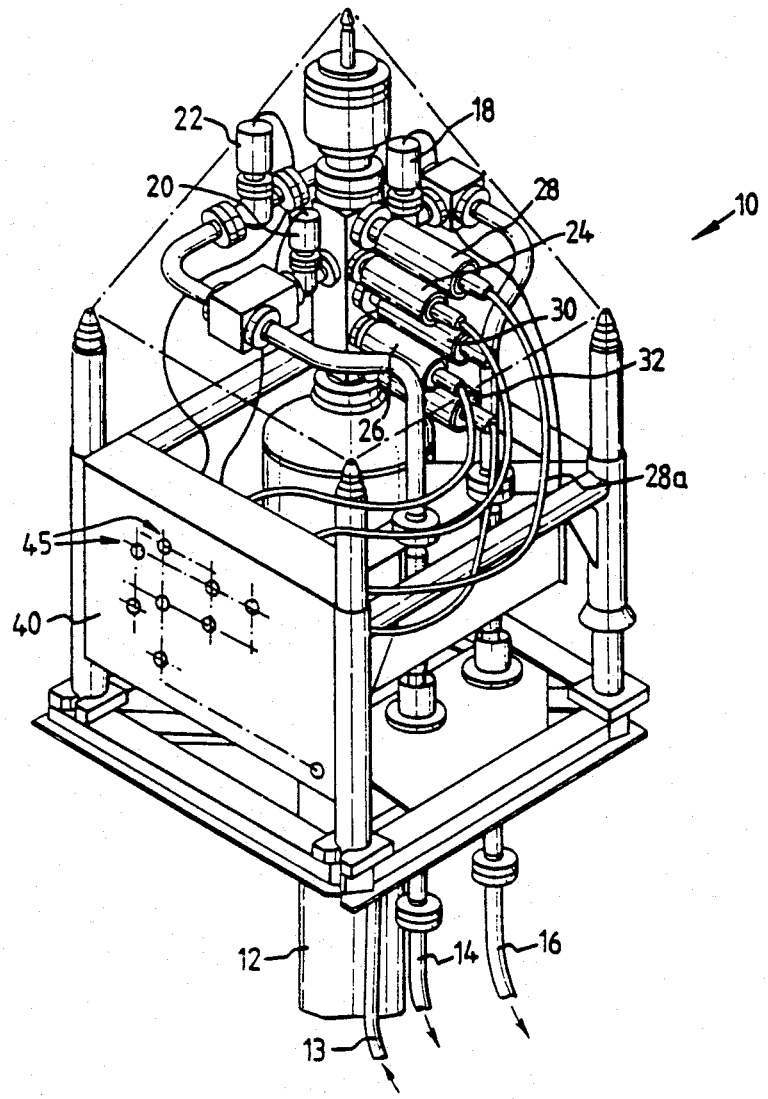
FIG. 1 is a general perspective view of a subsea well head with a production tree installation including an embodiment of the invention.

Referring to FIG. 1, a satellite well head installation, generally designated 10, is shown.

The well head installation is connected to a well head 12. Depending on the condition of a plurality of valves, described below, oil may be allowed to flow from the well head 12 through the tree 10 and via subsea pipelines 14, 16 to a central drilling rig (not shown).

The valve arrangement of the well head installation 10 is of standard form and includes a production ring valve 18, an annulus wing valve 20 (for controlling flow out of pipelines 14, 16), a bypass valve 22 connecting the two pipelines 14, 16 and five other valves, namely a annulus swab valve 24, an annulus master valve 26, a production swab valve 28, a production upper master valve 30 and a production lower master valve 32.

The operation of each main valve is controlled by a respective control element, (eg a pilot valve or hydraulic actuator) which is housed in a control device 80 connected to the main valve via a receptacle 50 and a hydraulic connection line. The connection line, control device and receptacle for the production swab valve 28 are labelled as 28*a*, 80*a*, 50*a* by way of example, in FIG. 2.

Figure 5:
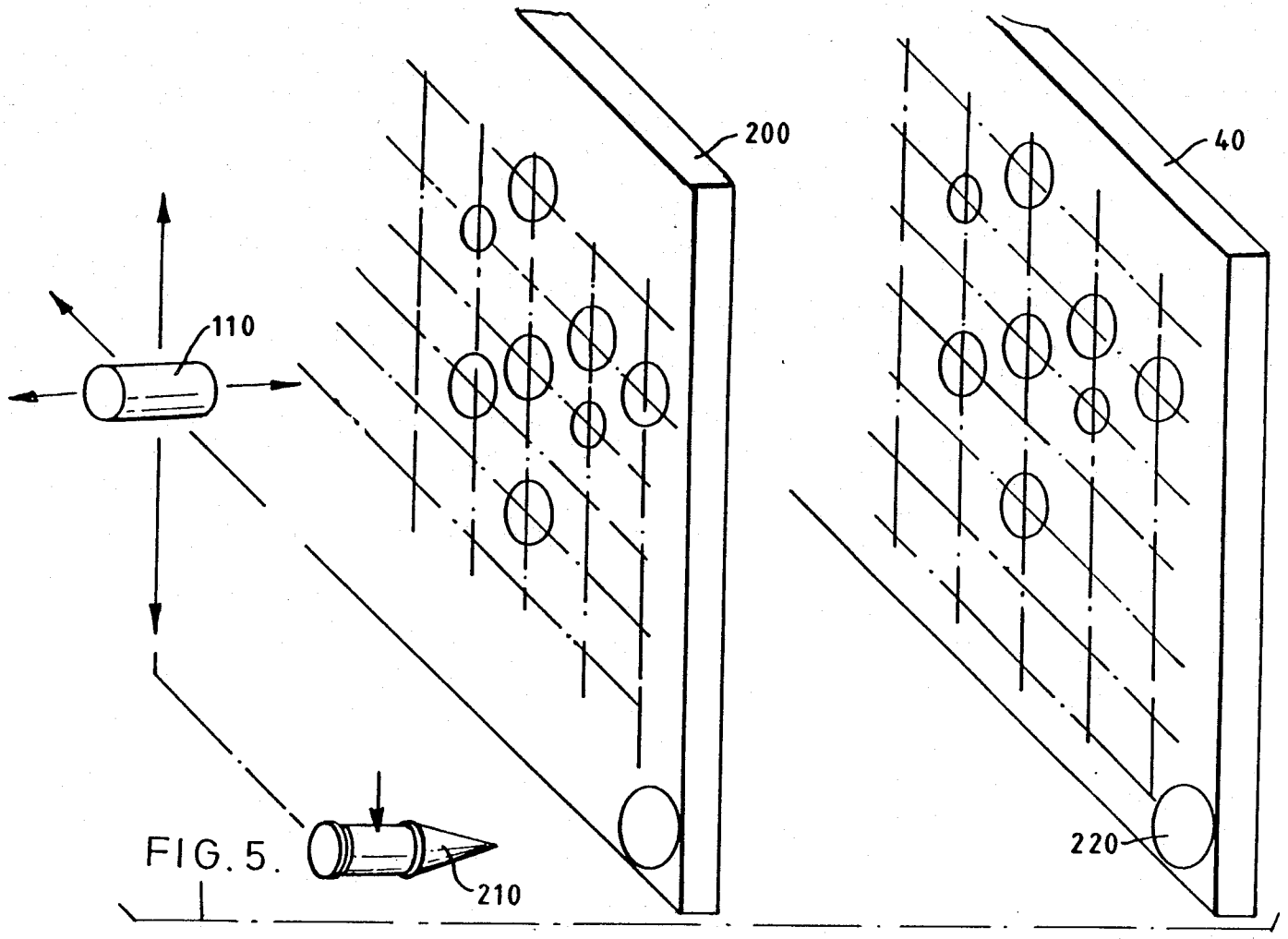
FIG. 5 is an enlarged perspective view of a manifold, and a corresponding template.

All the receptacles 50 are connected to openings 45 in a panel 40 in a predetermined pattern as shown in FIGS. 1 and 5. The panel also includes a further opening (or openings) 220 for receiving an indexing pin (or a plurality of indexing pins) 210 of a Remote Operator Vehicle (R.O.V.) 105.

Figure 3:
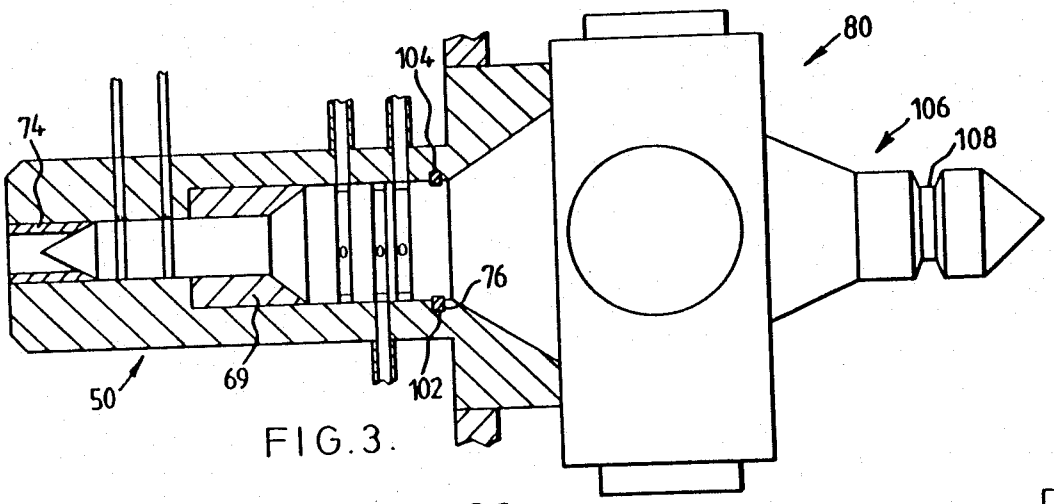
FIG. 3 is a sectional view of a control device and receptacle, showing a receptacle and control device engaged.
Figure 4:
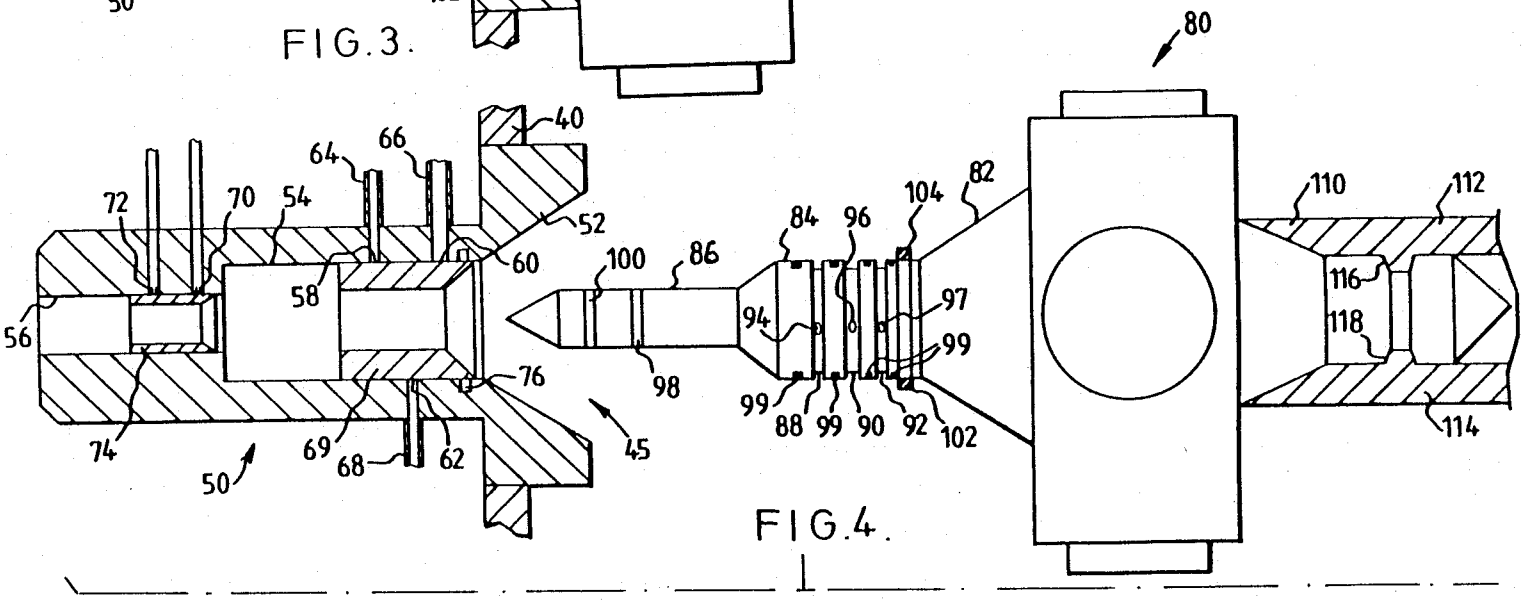
FIG. 4 is a cross-sectional view similar to that of FIG. 3, with the receptacle and control device disengaged.

With reference to FIGS. 3 and 4, a said receptacle 50, and corresponding control device 80 including the control element are shown in engaged and disengaged positions.

The receptacle 50 includes a hollow frusto-conical opening 52, a first hollow cylindrical portion 54, and a second hollow cylindrical portion 56 of smaller diameter than the first portion 54.

The first cylindrical portion 54 is provided, by way of example, with three openings 58, 60, 62 which are connected to hydraulic control lines 64, 66, 68. In practice, more openings may be employed. The openings 58-60-62 may be covered, when the control device 80 is not engaged with the receptacle 50, by a displaceable sleeve 69. The protective sliding sleeve 69 is formed from oil or grease filled non-corrosive material e.g. NYLON 66 and may be biased into the position shown in FIG. 4 by, for example, a spring (not shown) or other mechanical means.

The second cylindrical portion 56 is provided with first and second electrical contacts 70, 72. A second sleeve 74 is slidably disposed in the portion 56 and displaces dielectric oil over the electrical contacts and is biased into the position shown in FIG. 4 by a biasing means, for example a spring (not shown). The electrical contacts 70, 72 may be conductive or inductive.

The control device and receptacle are held together by locking means which, by way of example, may be a radial pin or series of pins (see below) engaging into a circumferential locking groove 76 shown adjacent the open end of the cylindrical portion 54.

The control device 80 is arranged to engage with the receptacle 50 and includes a second frustro-conical portion 82, third cylindrical portion 84 and fourth cylindrical portion 86 of similar form to corresponding portions 52, 54, 56, so that the control device 80 may be slidably engaged with the receptacle 50. The cylindrical portion 84 is provided with three circumferential grooves 88, 90, 92 disposed, when the control device 80 is engaged with the receptacle 50, in alignment with the openings 64–68. The grooves may, alternatively, be situated around openings 64–68 in receptacle 50. Each circumferential groove 88–92 is connected to an oil passageway 94, 96, 97, which passageways are connected to a control valve (not shown) disposed within the device 80. The three circumferential grooves are hydraulically isolated by elastomer seal rings 99.

The fourth cylindrical portion 86 includes one or more (in this case two) electrical contacts 98, 100 which are arranged to be disposed in electrical contact with the electrical contacts 70, 72 when the device 80 and receptacle 50 are engaged. The contact 98, 100 may be formed as conductive or inductive contacts, depending on the choice of contacts 70, 72. The contacts 98, 100 are connected to the control valve operating solenoid.

One or more (in this case two) retractable pins 102, 104 are also provided adjacent one end of the third cylindrical portion 84. These are arranged to engage selectively the circumferential groove 76 of the receptacle 50, so that the device 80 and receptacle 50 may be positively locked together.

The device 80 further includes a projection 106, having a recess 108. The projection 106 is shaped so as to be engagable with a hydraulically operated tool 110 of a Remote Operator Vehicle (R.O.V.) 105 to allow remote positioning of the control device by the R.O.V. 105 at a subsea location as shown in FIG. 4. The R.O.V. tool includes a pair of hollow semi-cylindrical jaws 112, 114 each provided with semi-circular projections 116, 118 which are arranged to engage the groove 108 of the device 80.

Preferably, the device 80 includes means to determine when the tool 110 is engaged with the projection 106, to retract the engagement pins 102, 104 while the tool 110 is engaged but to allow the pins 102, 104 to project from the third cylindrical projection 84 when the tool 110 is released.

Figure 2:
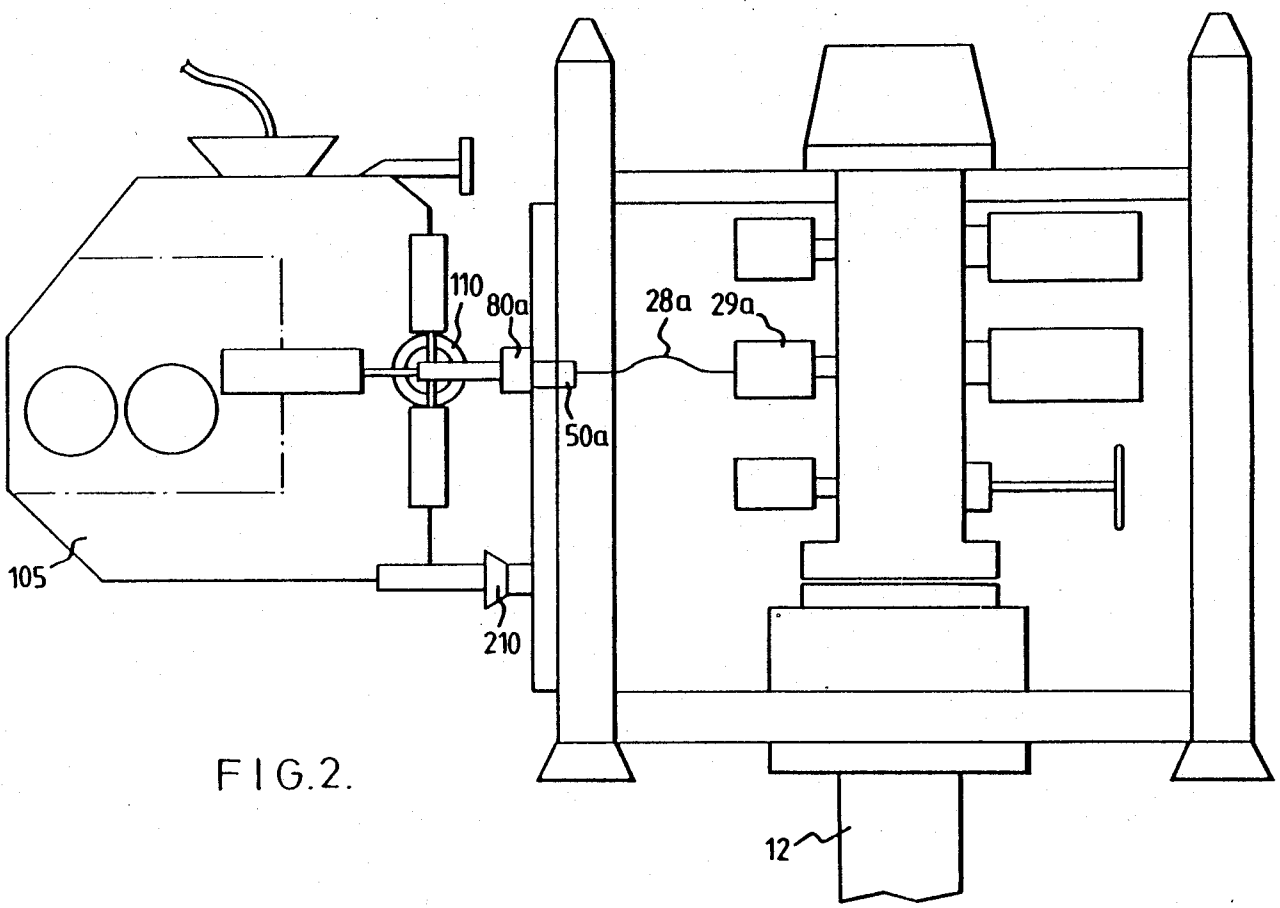
FIG. 2 is a cross-sectional view of a well head installation similar to that shown in FIG. 1, also showing a remote vehicle.

Thus, as shown in FIG. 2 when the R.O.V. 105 is positioning the device 80 in the receptacle 50, the engagement projections 102, 104 will be retracted but once the device has been positioned in the receptacle 50, and the R.O.V. tool 110 is released, the projections are allowed to engage the circumferential groove 76, thus locking the receptacle 50 and device 80 together.

In order to prevent any seawater remaining adjacent the hydraulic and electrical connections between the device and receptacle when engaged, the sleeves 69, 74 are preferably connected to an oil supply cylinder so that, when the sleeves are displaced from the position shown in FIG. 4 to that shown in FIG. 3, a supply of oil is displaced across the connection surfaces to dispel any seawater, through oil ways (not shown).

In use, the subsea installation would initially be provided with a full complement of control devices 80, one for each main valve shown in FIG. 1. The control devices would be of the general form shown in FIGS. 3 and 4, each connected to a respective receptacle 50 in the panel 40. Control signals to the valve of a said control device 80 would be passed through the appropriate receptacle 50 via at least one of the hydraulic and/or electrical connections between the receptacle and device, which control signals would be supplied from a central drilling rig or other surface installation via a control umbilical 13, as shown in FIG. 1.

The control valve, of the control device 80 would then respond to such control signals to operate its associated main valve of the installation, in accordance with the control signals received, the control valve sending open/close hydraulic (or electrical) signals via others of the electrical and hydraulic connections between the receptacle and device to the appropriate main valve.

If at any stage during operation, one of the control valves fails, it is only necessary for an underwater remote vehicle (R.O.V.) to be guided down to the well head installation. The tool 110 of the R.O.V. can then be manoeuvred to remove the faulty control device 80 and replace the faulty device with a new unit.

As previously mentioned, the receptacles, 50 are disposed in the panel 40 in a predetermined pattern as, for example, shown in more detail in FIG. 5. Once the manifold pattern has been chosen, a template 200 can be made corresponding to the receptacle pattern.

This may then be used to program accurately the movements of the R.O.V. tool 110 that will be required in order for the R.O.V. to recover the faulty component and replace this with a fully operational substitute.

Using the template 200, a dry run may be effected on the surface completely under computer control, with the necessary movements being stored in the memory of the computer. Then, all that is necessary is for the R.O.V. to be aligned, using its indexing pin or pins 210, with the corresponding opening or openings 220 of the manifold 40 at the subsea installation, the R.O.V. then completing the operation without needing any further assistance from the surface. This method of operation has particular advantages in low visibility situations.

Materials for the apparatus are selected in order for compatability with sea-water environment, evaluation of electrolyses, earth grounding and type of hydraulic control fluid. For example, body/bolting: Stainless steel, moving parts: Monel/Inconel/Alu bronze. Electrical contacts: gold plated.

Figure 6:
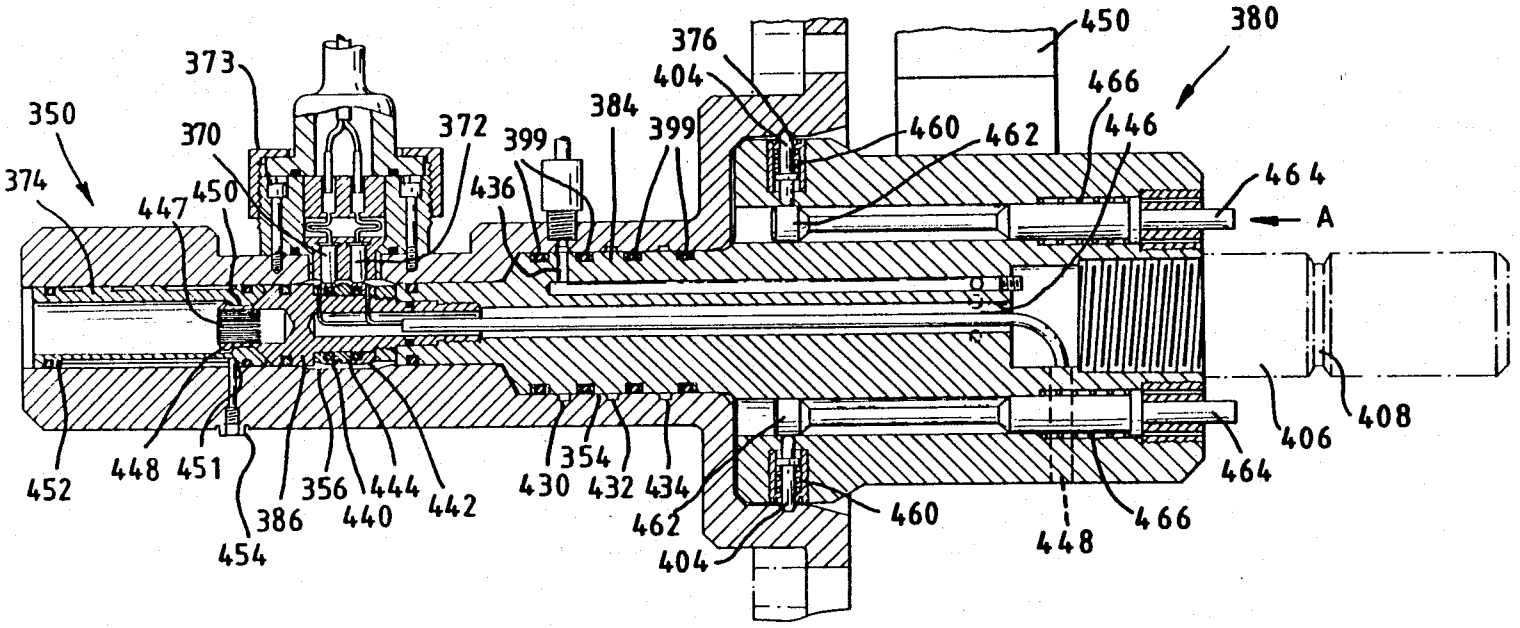
FIG. 6 is a sectional view, similar to FIG. 3, of a second embodiment of the invention.

FIG. 6 shows a second embodiment of the invention. The control device and receptacle of this embodiment have substantial similarities to those of the embodiment of FIGS. 3 and 4 and similar parts are represented by the same reference numerals, with the addition of 300. The major difference between this embodiment and the embodiment of FIGS. 3 and 4 are as follows:

HYDRAULIC CONTROL CONNECTIONS

In this embodiment no displacable sleeve for the hydraulic openings is provided. The arrangement of the hydraulic openings on the receptacle/device has also been reversed, so that annular grooves 430, 432, 434 are provided on the receptacle 350 and corresponding openings and oilways, which are in alignment with respective grooves when device and receptacle are engaged are provided on the device 380 of which one, labelled 436 is shown. The three oilways all communicate, through the internal structure of the device 380, with a pilot valve contained within a housing, 450.

The seal rings 399 are spaced at different intervals so that, on entry of the device into the receptacle, the seal rings do not all pass the grooves 430, 434 at the same time thus smoothing entry.

The three circumferential grooves 430, 432, 434 provide, respectively, a pressure return line and two control lines. The pressure return line is configured to be closest to the inserted end of the device 380 as this is the hydraulic connection most likely, of the three, to fail, due to the greater abrasion which the adjacent seals may suffer when the control device 380 is inserted in the receptacle 350.

ELECTRICAL CONTROL CONNECTIONS

Two electrical contacts 370, 372 are provided on the receptacle 350 and these are connected to the control umbilical via an electrical connector 373. Respective self activated slip rings 440, 442 are provided on the control device 380. These slip rings are radially resilient so as to be forced into biased contact with the contacts 370, 372 when the device 380 is engaged with receptacle 350. Contact is preferably enhanced by means of an annular ring of resilient material, for example synthetic plastics 444 formed between the free ends for the slip rings 440, 442. Electrical connections from the slip rings run internally of the device 380 through conduit 446 and emerge through opening 448 for external connection, via a sheathed cable, to an actuating solenoid in the housing 450.

The sleeve 374, unlike the embodiments of FIGS. 3 and 4, is not biased into the covered position but is simply slidable between an 'open' position, shown in FIG. 6, and a covered position in which the sleeve covers the contacts 370, 372. The control device 380 is provided with a resilient, radially deformable tip 447 which has a lip 448 for engagement with a corresponding lip 450 formed on the sleeve 374. The sleeve 374 further includes radial projections 451, 452 separated by an axial slot, which cooperate, in the open and covered positions respectively with a stop 454 provided on the receptacle 350. In use, when the control device 380 is inserted in the receptacle 350, the tip 447 forces the sleeve 374 axially to the position shown in FIG. 6. At the end of the sleeve's allowable travel, the radial projection 451 abuts against the stop 354 which allows the tip 447 to snap into engagement with the sleeve 374, the lips 448, 450 cooperating. When the control device 380 is removed, the tip 447 pulls the sleeve 374 axially until the projection 452 abuts against stop 454 at which time the resilient tip 447 disengages from the sleeve 374, leaving the sleeve in the covered position.

A spring loaded detent device, for example a captive spring biased ball bearing, is preferably located at the tip of the projection 452, the ball bearing being arranged to engage a hollow formed in the sleeve 374 adjacent projection 452, to provide retention of the sleeve 374 in the covered position, but allow release when forced by insertion of the device 380.

LOCKING MECHANISM

The locking mechanism comprises two pins 404 which engage with a circumferential groove 376. The pins 404 have a semi-spherical tip, with the groove having a cooperating trapezoidal cross section. Each pin 404 is biased inwardly by means of a respective spring 460 and is held in the outward position, as shown in FIG. 6, by a respective axially movable piston 462. Each piston is connected to a respective actuating pin 464 via a retention spring 466 which holds the piston 462 in the locked position shown in FIG. 6. In use, to release the locking mechanism, the pins 464 are engaged by an annular piston connected to the operating tool of the ROV. This causes the pistons to move in direction A, so that the pins spring inwardly, thus releasing the control device 380. In the event of one or more springs 460 failing, the cooperating surfaces of the pin and groove allow the control device to still be released as, when pulled, the pins 404 of the control device 380 will ride out of the trapezoidal groove 376.

While the embodiment of the invention has been described as part of a wellhead installation, this is not to be construed as limitative, as the invention is applicable to any underwater or surface installation and is particularly suited for any other non-benign environment e.g. in a radioactive application. Furthermore, although the control device comprises a control valve in the examples, any control element, for example a hydraulic actuator, may be used.

We claim:

1. An apparatus for controlling an underwater installation, said apparatus comprising:

a first control device for providing a first control function for the underwater installation;

a second control device for providing a second control function for the underwater installation, said first and second control devices having means for being releasably connected to a remote underwater vehicle; and connection means for connecting said control devices to the underwater installation;

said connection means comprising a connection panel, a first connector coupled to said connection panel at a first predetermined location, and a second connector coupled to said connection panel at a second predetermined location;

said first control device comprising a first control element and a first engagement member, said first engagement member being independently slidably engageable with and disengageable from said first connector, said first engagement member including means for transferring hydraulic and electrical signals from said first control device to the underwater installation when said first control device is engaged with said first connector;

said second control device comprising a second control element and a second engagement member, said second engagement member being independently slidably engageable with and disengageable from said second connector, said second engagement member including means for transferring hydraulic and electrical signals from said second control device to the underwater installation when said second control device is engaged with said second connector;

said connection panel including means for receiving at least one indexing device of said remote underwater vehicle, whereby the remote underwater vehicle can engage with said connection panel and independently recover and replace said control devices from said connectors.

2. Apparatus as claimed in claim 1 wherein one of said first device and first connector comprises a receptacle and the other comprises a projection to be received in the receptacle.

3. Apparatus as claimed in claim 2 wherein the receptacle comprises first and second generally cylindrical portions.

4. Apparatus as claimed in claim 1 wherein said signals transferring means of said first control device comprises at least one first opening disposed in the first device and at least one second opening disposed in the first connector, the first and second openings being in fluid communication when the first device and first connector are engaged.

5. Apparatus as claimed in claim 4 wherein one of the first and second openings includes an annular slot in fluid communication with the other opening when the first device and first connector are engaged.

6. Apparatus as claimed in claim 4 wherein said signals transferring means of said first control device comprises at least one first electrical contact coupled to the first device and at least one second electrical contact coupled to the first connector whereby said first and second contacts are in electrical communication when the first device and first connector are engaged.

7. Apparatus as claimed in claim 6 wherein the at least one first contact comprises a slip ring.

8. Apparatus as claimed in claim 7 wherein the slip ring is self activated.

9. Apparatus as claimed in claim 6 wherein said first connector includes sleeve means for covering said at least one second opening of the first connector when the first connector is not engaged with the first control device.

10. Apparatus as claimed in claim 9 wherein said sleeve means comprises a first sleeve arranged to cover said at least one second electrical contact of the first connector.

11. Apparatus as claimed in claim 10 wherein the sleeve means comprises a second sleeve arranged to cover said at least one second opening of the first connector.

12. Apparatus as claimed in claim 2 wherein the receptacle is formed as part of the first connector.

13. Apparatus as claimed in claim 1 wherein said first control device includes locking means for engagement with the first connector, for locking the first control device and first connector together.

14. Apparatus as claimed in claim 13 wherein the locking means comprises at least one retractable catch engageable with a corresponding groove.

15. Apparatus as claimed in claim 14 wherein the groove is of trapezoidal cross section and the at least one catch is of arcuate cross section.

* * * * *